US011214342B2

(12) United States Patent
Brown et al.

(10) Patent No.: US 11,214,342 B2
(45) Date of Patent: Jan. 4, 2022

(54) SURVIVAL SYSTEMS

(71) Applicant: SURVITEC GROUP LIMITED, Birkenhead (GB)

(72) Inventors: Elizabeth Brown, Liverpool (GB); Paul Oliver, Rhyl (GB); Nigel Parkes, Salisbury (GB); Alkistis Kokorikou, Liverpool (GB)

(73) Assignee: SURVITEC GROUP LIMITED, Birkenhead (GB)

( * ) Notice: Subject to any disclaimer, the term of this patent is extended or adjusted under 35 U.S.C. 154(b) by 0 days.

(21) Appl. No.: 16/486,801

(22) PCT Filed: Feb. 15, 2018

(86) PCT No.: PCT/EP2018/053820
§ 371 (c)(1),
(2) Date: Aug. 16, 2019

(87) PCT Pub. No.: WO2018/149933
PCT Pub. Date: Aug. 23, 2018

(65) Prior Publication Data

US 2020/0031440 A1 Jan. 30, 2020

(30) Foreign Application Priority Data

Feb. 17, 2017 (GB) ..... 1702609

(51) Int. Cl.
*B63C 9/18* (2006.01)
*B63C 9/125* (2006.01)
(Continued)

(52) U.S. Cl.
CPC ..... *B63C 9/1255* (2013.01); *A41D 13/0007* (2013.01); *A41D 13/0125* (2013.01);
(Continued)

(58) Field of Classification Search
CPC ..... B63C 9/1255; B63C 9/155; B63C 9/18; B63C 9/081; A41D 13/0007; A41D 13/0125
See application file for complete search history.

(56) References Cited

U.S. PATENT DOCUMENTS 1,960,474 A * 5/1934 Browne ..... B63C 9/08 441/129
2,842,785 A * 7/1958 Sieverts ..... B63C 9/1255 441/92

(Continued)

FOREIGN PATENT DOCUMENTS

EP 0325994 A1 8/1989
EP 1481889 A1 12/2004

(Continued)

OTHER PUBLICATIONS

International Search Report and Written Opinion dated Jun. 29, 2018, in related PCT Application No. PCT/EP2018/053820.

(Continued)

*Primary Examiner* — Stephen P Avila
(74) *Attorney, Agent, or Firm* — Maschoff Brennan

(57) ABSTRACT

A personal survival system for use in water includes an inflatable chamber (9) and in inflation system (31) operable to inflate the inflatable chamber (9), wherein the inflation system (31) is mounted separately from and remotely from the inflatable chamber (9). Also disclosed are: a survival system for use in water includes an inflatable chamber including an inner layer and an outer layer, wherein the inner layer is separate from the outer layer; an inflation control system for use with an in-water survival system, the inflation control system comprises a selectively sealable chamber configured to contain water-triggered automatic inflation device of the survival system; and a personal survival (Continued)

system including an inflatable bladder and a moulded cover constructed from a flexible polymer.

4 Claims, 24 Drawing Sheets

(51) Int. Cl.
*A41D 13/00* (2006.01)
*A41D 13/012* (2006.01)
*B63C 9/08* (2006.01)
*B63C 9/15* (2006.01)

(52) U.S. Cl.
CPC ..... *B63C 9/081* (2013.01); *B63C 9/155* (2013.01); *B63C 9/18* (2013.01)

(56) References Cited

U.S. PATENT DOCUMENTS 6,231,411 B1 5/2001 Vinay
7,937,770 B1 5/2011 Hernandez
9,481,144 B1* 11/2016 Duggal ..... B64D 25/14
2005/0020155 A1* 1/2005 Spagnuolo ..... A41D 7/003 441/92
2005/0201155 A1 9/2005 Shih
2009/0098784 A1* 4/2009 Medford ..... B63C 9/24 441/95
2013/0014310 A1 1/2013 Tang
2014/0213128 A1* 7/2014 Hughes ..... B63C 9/1255 441/92
2014/0216240 A1* 8/2014 Hellweg ..... F41H 1/02 89/36.05
2016/0280342 A1* 9/2016 Fawcett, Jr. ..... B63C 9/18
2017/0029108 A1* 2/2017 Potter ..... B64D 1/08
2017/0318981 A1* 11/2017 Duwell ..... A47C 27/10

FOREIGN PATENT DOCUMENTS

JP H09301272 A 11/1997
KR 20020041343 A 1/2002
WO 2014083210 A1 6/2014

OTHER PUBLICATIONS

United Kingdom Search Report dated Aug. 16, 2017, in related Application No. GB1702609.7.
Examination report from the European Patent Office dated Sep. 11, 2020 regarding European Application No. 18706694.9-1015.

* cited by examiner

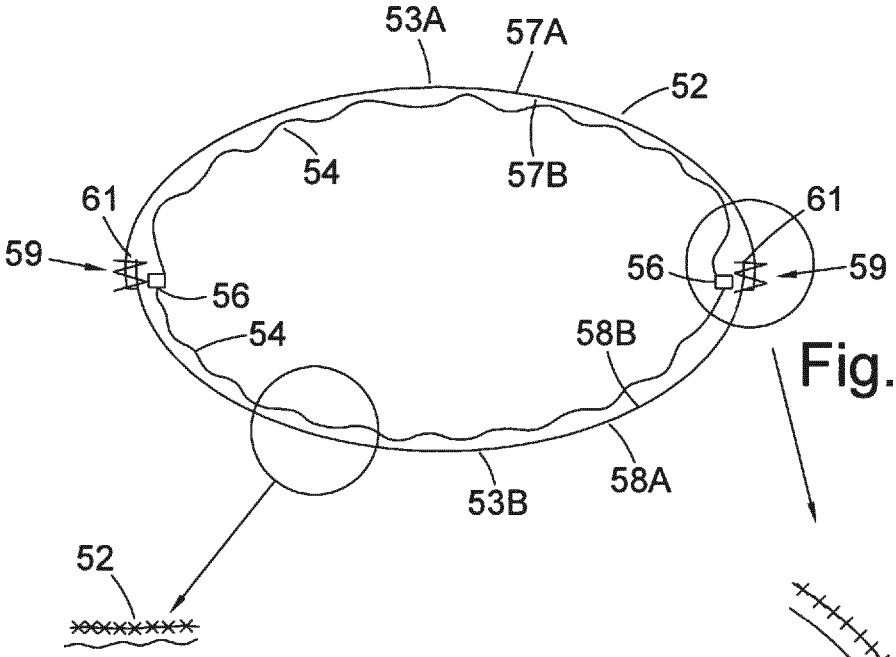
Fig. 10A
Fig. 10B
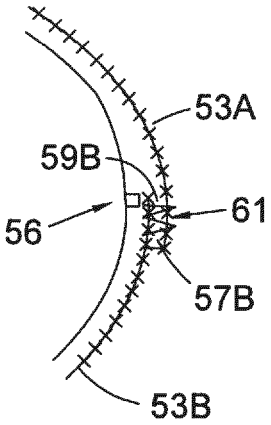
Fig. 10C

*Conventional cover*

SURVIVAL SYSTEMS

TECHNICAL FIELD

The present invention relates to survival systems, such as those for use in water and including an inflatable chamber—e.g. lifejackets and small single seat liferafts. The present invention also relates to an inflation system for a survival system.

BACKGROUND TO THE INVENTION

First Aspect

As shown in FIGS. 1A and B, traditional inflation systems 1 are mounted directly onto the lifejacket 3 such that the inflation system 1, which consists of a compressed gas cylinder 5 and an activation mechanism 7, is mounted directly onto the inflatable structure (bladder) 9 and the gas enters the inflatable structure through a valve 11 (typically a Schrader valve), as shown in FIG. 2. The inflation system 1 can be activated manually (by pulling on a lever 13) or automatically by a water activated device 15 acting on a piercing pin 14.

The inflation system 1 is typically many times the weight of the bladder 9 and cover, and is bulky and hard. In a lifejacket 3, for example worn by a pilot or aircrew, the inflation system is included in the cover that containers the bladder 9. The additional weight and bulk of the inflation system 1 is a hindrance to the wearer as the position of the lifejacket 3 on the chest, as shown in FIGS. 1A and 1B, interferes with the many other items of equipment worn in this area and also with a harness system if worn. Additionally, the weight of the inflation system 1 in that position on the chest, when the pilot is experiencing acceleration, is increased which may further interfere with the pilot's breathing etc.

Additionally the inflation system, because it is hard and heavy, causes wear of the relatively delicate bladder system.

When the wearer is wearing bulky and buoyant clothing or an immersion garment it is possible that the inflation system 1, when it is mounted on the wearer, will remain above the water as shown in FIGS. 3A and 3B, and not activate which could lead to the wearer drowning.

Second Aspect

As shown in FIGS. 4, 5A, and 5B, a conventional lifejacket uses a single layer of material 20 that consists of a textile supporting sheet 22 (for example nylon or polyester) coated or laminated on the inside with a sheet 24 of flexible, air impermeable polymer such as neoprene or polyurethane. The coated two-layer material is typically stiff because of the relative thickness of the material and it is typically joined at its edges by welding or gluing the material together to form a seam 26. The resistance of the bladder to bursting from over pressure is dependent on the strength of the weld in peel and the strength of the welded or glued seam 26 is only as strong as the bonding of the polymer layer 24 to the supporting textile 22. Furthermore, when the outer textile 22 is coated with the polymer 24 its tear strength is greatly reduced and therefore a stronger and thicker textile must be used.

Third Aspect

Known lifejackets are provided with automatic inflators which are triggered automatically on contact with water. The inflator releases compressed gas from a cylinder in order to inflate the bladder of the lifejacket and provide buoyancy for the wearer.

It can be advantageous to disable the automatic inflator in certain situations when there is a risk that the inflators will be exposed to moisture or water but when it would be undesirable for the lifejacket to inflate. Special forces for example may wish to disable automatic inflation during covert operation or when swimming, but at other times will wish to have the automatic inflation facility activated—such as when boarding a vessel.

Known arrangements provide a cap or plug that seals off an automatic inflator by preventing water entering a chamber. Such known arrangements have the disadvantage of requiring an additional, separate part, which can be fiddly to operate and difficult to fit.

Fourth Aspect

Typically covers for inflatable lifejackets are designed by making an outer cover from stitched or welded panels of a textile that are shaped to conform to the overall shape of the bladder when it is deflated. The cover is closed over the bladder by a zipper or Velcro® or press studs etc. built into the cover such that when the bladder is filled with gas from the inflation system the pressure of the gas inside the cover will open the zipper or Velcro or press studs and allow the bladder to expand outwards. Such arrangements are liable to damage and wear and are expensive to manufacture.

The embodiments of the present invention seek to address the disadvantages of these known aspects of survival systems.

SUMMARY OF THE INVENTION

According to a first aspect of the invention, there is provided a personal survival system for use in water including an inflatable chamber and an inflation system operable to inflate the inflatable chamber, wherein the inflation system is mounted separately from and remotely from the inflatable chamber.

A personal survival system may be provided, including an inflatable chamber and an inflation system operable to inflate the inflatable chamber, wherein the inflation system is configured to be mounted spaced apart on a wearer's body from the inflatable chamber. A mounting system may be provided for locating the inflation system and the inflatable chamber so that they are spaced apart on the wearer's body. The mounting system may be provided for locating the inflation system and the inflatable chamber so that they are spaced apart on the wearer's body at substantially the same positions prior to and after inflation of the inflatable chamber. The mounting system may comprise a fabric support or rigid frame or a garment.

The personal survival system may include a tube providing a fluid connection between the inflation system and the inflatable chamber.

The inflation system and the inflatable chamber may be mounted on a wearer's body. The inflation system may be mounted at a position that is more likely to be fully immersed in water in an emergency than the inflatable chamber, such as at or near the waist.

The inflatable chamber may be configured to be mounted on the upper body of the wearer—such as the shoulders, neck and/or chest. The chamber may have a horse-shoe shape for fitting around the back of wearer's neck and resting against the wearer's chest.

Two or more inflatable chambers may be provided.

The inflation system may comprise a compressed gas container and/or an activation mechanism for triggering inflation.

According to a second aspect of the invention, there is provided a survival system for use in water including an inflatable chamber including an inner layer and an outer layer, wherein the inner layer is separate from the outer layer.

The outer layer comprises two sheets that are material that are stitched together "in sheer".

The survival system may include a low friction material between the inner layer and the outer layer.

The outer layer may be substantially inelastic.

According to a third aspect of the invention, there is provided an inflation control system for use with an in-water survival system, the inflation control system comprising a selectively sealable chamber configured to contain water-triggered automatic inflation device of the survival system.

The selectively sealable chamber may have an unsealed state which allows water to enter the chamber and trigger the automatic inflation device and a sealed state which prevents water from entering the chamber and trigger the automatic inflation device.

The inflation control system may include a releasable lock to secure the selectively sealable chamber in the sealed state.

The inflation control system may include an indicator operable to indicate whether the selectively sealable chamber is in the unsealed state or the sealed state.

The selectively sealable chamber may be sealed by a zipper.

The inflation control system may be incorporated into a body of the in-water survival system.

The inflation control system may be mounted separately from and remotely the body of the in-water survival system.

According to a fourth aspect of the invention, there is provided a personal survival system including an inflatable bladder and a moulded cover constructed from a flexible polymer. The cover may be seamless. The closure of the moulded cover is by a "tongue and groove seam", e.g. like a "ziplock bag".

BRIEF DESCRIPTION OF THE DRAWINGS

For a better understanding of the present invention embodiments will now be described by way of example, with reference to the accompanying drawings, in which:

FIG. 10A shows a cross-sectional view of an inflatable chamber according to a second embodiment of the invention;

FIG. 10B shows an enlarged detailed view of the layers of the inflatable chamber according to the second embodiment;

FIG. 10C shows an enlarged view of the inflatable chamber where the upper and lower layers are connected together;

In the drawings, like elements are generally designated with the same reference sign.

DETAILED DESCRIPTION OF EMBODIMENTS OF THE INVENTION

First Embodiment

Figure 1A:
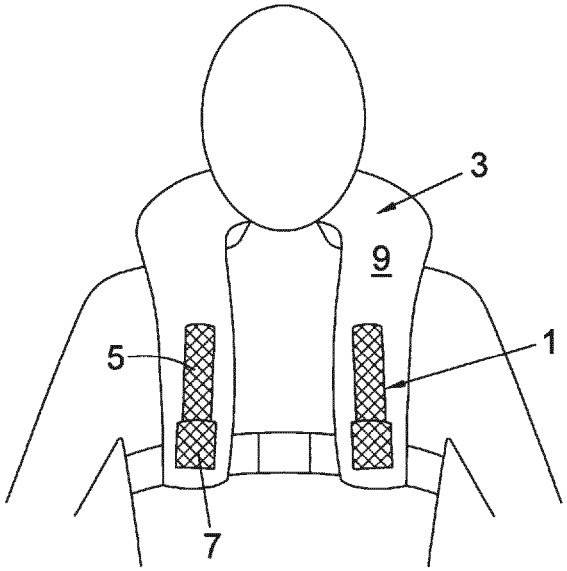
Fig. 1A Prior art
FIG. 1A shows a front elevation of a known lifejacket and inflation system worn by a wearer.
Figure 1B:
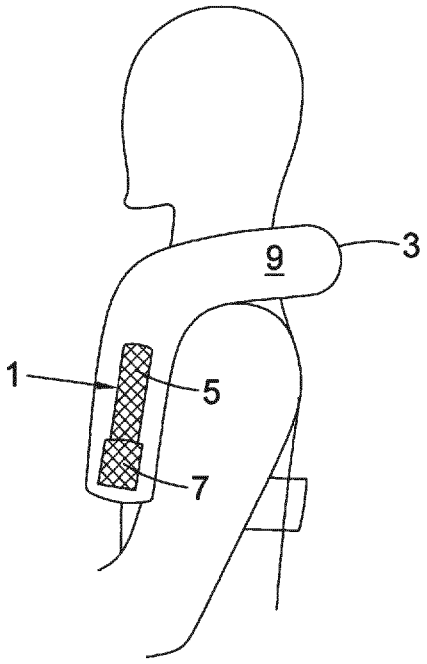
Fig. 1B Prior art
FIG. 1B shows a side elevation of the known lifejacket and inflation system of FIG. 1A.
Figure 6:
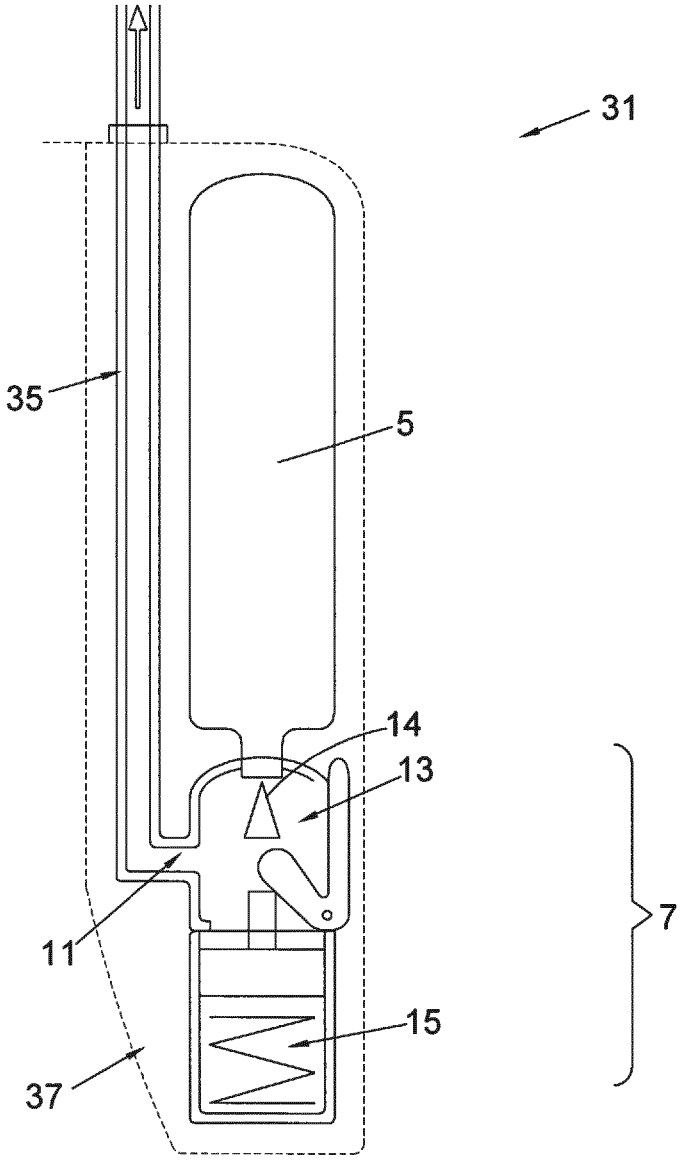
FIG. 6 shows a partial cross-sectional view of an inflation system according to a first embodiment of the invention.
Figure 7A:
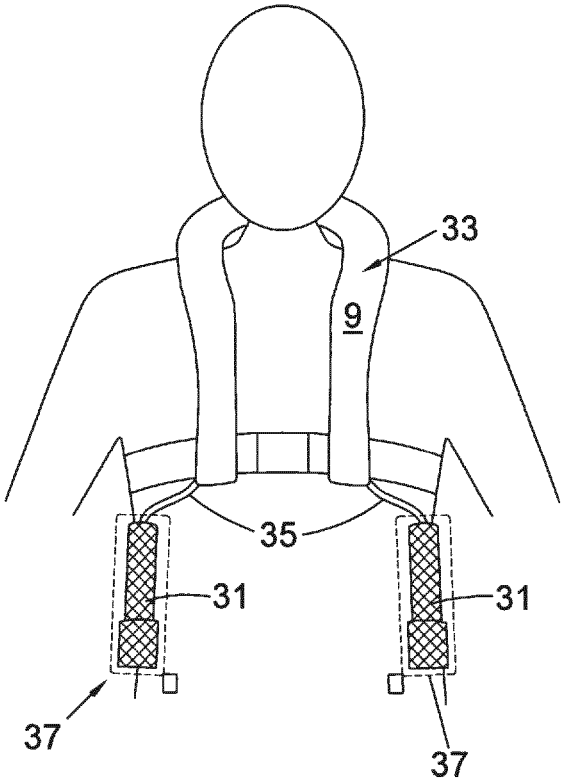
FIG. 7A shows a front elevation of a lifejacket incorporating the inflation system of the first embodiment of the invention.
Figure 7B:
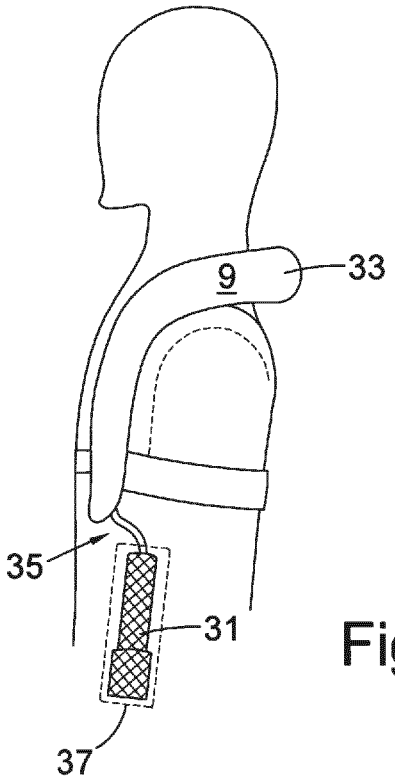
FIG. 7B shows a side elevation corresponding to the front elevation of FIG. 7A.

In this embodiment a lifejacket, as shown in FIGS. 6, 7A and 7B, or small single seat liferaft is modified such that, instead of the inflation system being directly mounted onto the buoyancy-providing bladder as described above in relation to FIG. 1 to 3, it is remote from the bladder and connected to it by a flexible tube through which the compressed gas can pass from the inflation system into the bladder.

The inflation system 31 include a compressed gas cylinder 5 and an activation mechanism 7, similar to the known arrangement. When activated, compressed gas from the cylinder 5 passes through a valve 11 into a flexible tube 35 from where it is passed to the bladder 9 in order to inflate the bladder 9. The inflation system can be activated manually (by pulling on the lever 13) or automatically by a water activated device 15.

In the drawings of this embodiment two inflators 31 are shown. However, there may be one inflator or more than two inflators. The inflator or inflators 31 may be mounted in a pocket that is attached to a harness, belt or jacket/vest of the wearer. The pocket is indicated by dashed lines 37 in the drawings.

The embodiment allows the heavy, bulky and hard inflation system 31 to be mounted onto the wearer in a position that is better for the wearer and causes less obstruction and interference to the wearer's memorability and comfort.

The wear on the bladder 9 may be greatly reduced by having the inflation system 31 remote to the bladder 9.

Figure 8A:
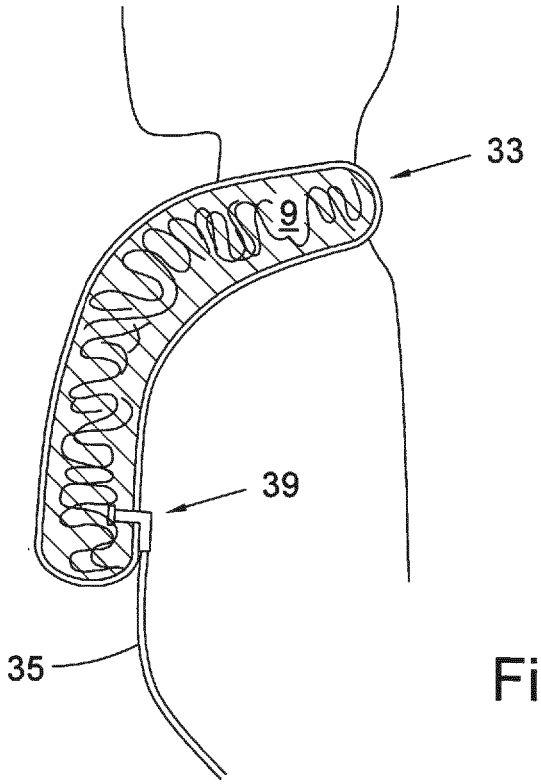
FIG. 8A shows a part cross-sectional side elevational view of a lifejacket in accordance with the first embodiment of the invention when in an inflated state.
Figure 8B:
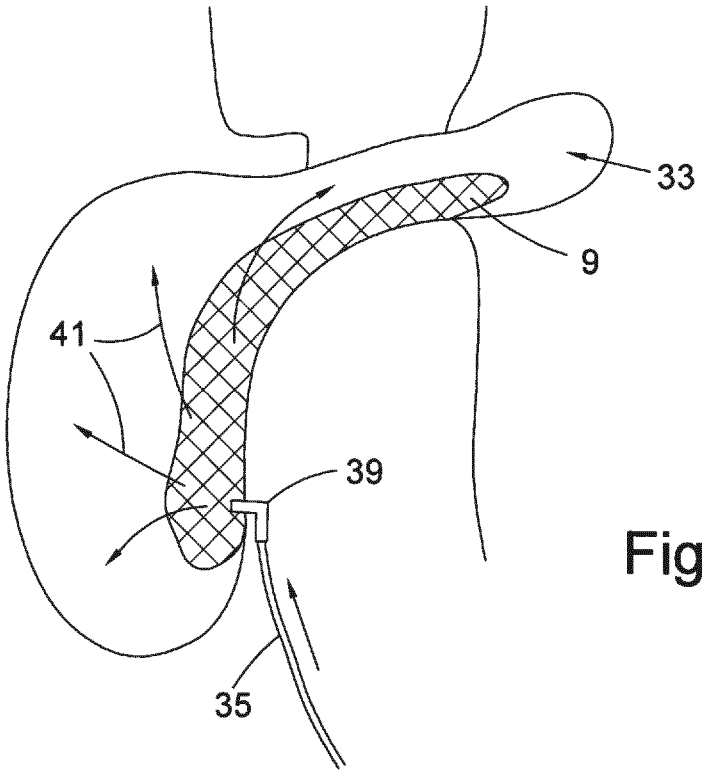
FIG. 8B shows a view corresponding to that of FIG. 8A prior to inflation of the lifejacket.

FIGS. 8A and 8B show in more detail how the inflation system 31 is connected to the bladder 9.

When the inflation system 31 is activated (either manually or automatically), compressed gas from the cylinder 5 is released by movement of the piercing pin 14. The compressed gas flows via the valve 11 along the tube 35 and enters the bladder 9 of the lifejacket 33 via a connector 39. Gas causes the bladder to inflate from the generally deflated state as shown in FIG. 8B, as indicated by arrows 41, into the inflated state, as shown in FIG. 8A, to fill the lifejacket 33 body and provide buoyancy for the wearer.

Another benefit is that inflation systems 31 need to be regularly checked and serviced as they contain pressurised gas and this process normally requires the lifejacket 33 to be unpacked and the inflation system 31 removed for servicing. By using this embodiment, the inflation system 31 can be easily detached for inspection and servicing without the need tom unpack the bladder 9.

Figure 9A:
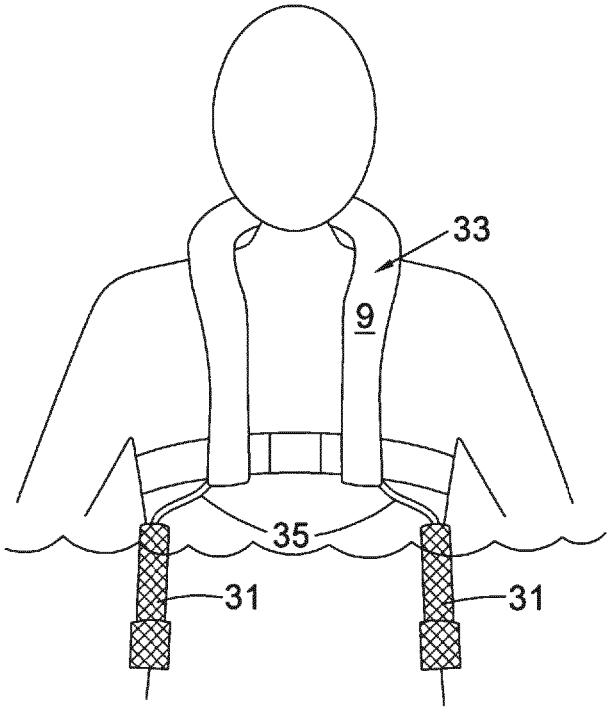
FIG. 9A shows a front elevation of a lifejacket according to the first embodiment in which the wearer is partially immersed in water.
Figure 9B:
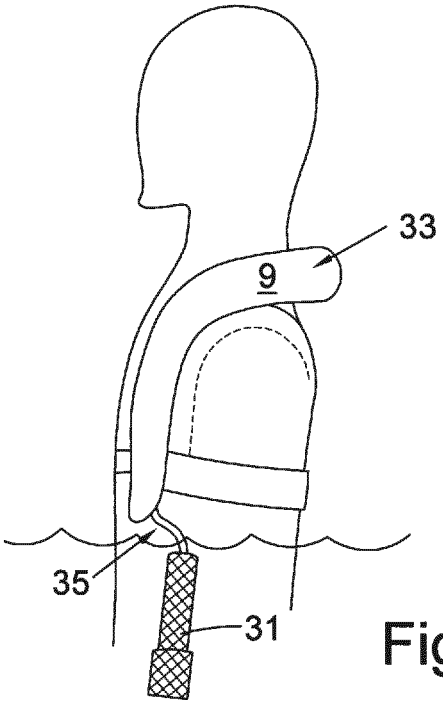
FIG. 9B shows a side elevation corresponding to the front elevation of FIG. 9A.

A further benefit of the remote inflation system 31 is that it can be mounted in a position whereby the (automatic) water activation part 15 of the inflation system 31 can be positioned lower on the wearer's body, as shown in FIGS. 9A and 9B, so that it ensures it will be fully immersed when the wearer falls into the water. This should be contrasted with the known arrangement described above in relation to FIGS. 3A and B. The inflation system may, e.g., be mounted at or near the waist of the wearer.

The lifejacket bladder 9 may be contained in a cover and/or is incorporated into a survival vest or harness or ballistic protection vest or garment. The remote inflation system 31 may be either housed in a pocket on the garment or is contained in its own packet that can be attached to the vest or garment in a suitable position.

The bladder 9 (and lifejacket 33) may remain in substantially the same position before and after inflation. The bladder 9 (and lifejacket 33) located on the body of the wearer by any suitable means, such as by being shaped to pass around the neck of the wearer and/or having a chest strap. Bladder 9 (and lifejacket 33) are mounted in deployment position prior to inflation (rather than being moved position by as a result of inflation). This may allow better (semi-permanent) location of the bladder 9 (and lifejacket 33) and provide more rapid deployment. The bladder 9 (and lifejacket 33) may be located by a rigid or partially rigid frame so that they remain in substantially the same position before and after inflation.

Figure 20:
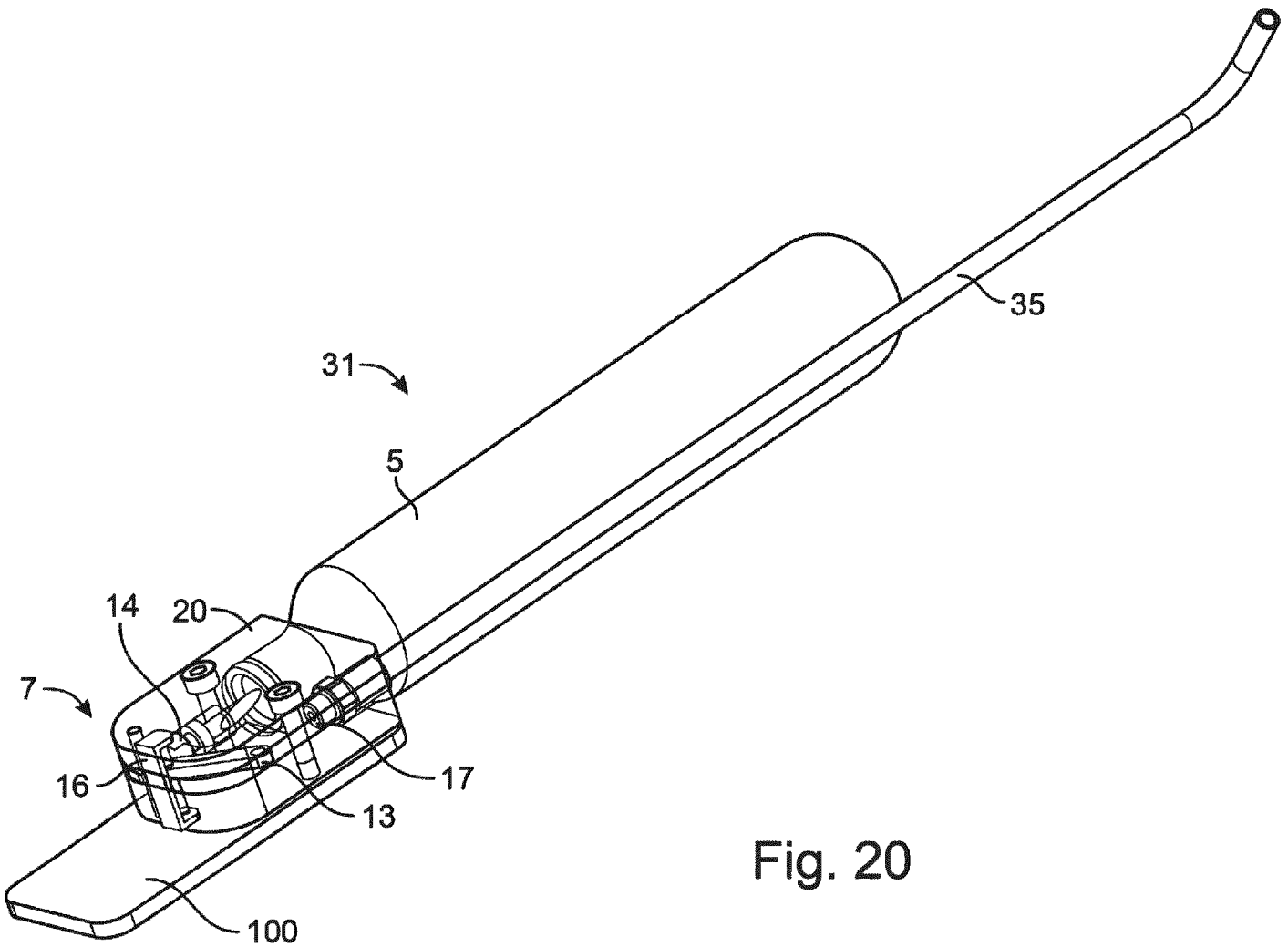
FIG. 20 shows a perspective view of a modified inflation system according to a first embodiment of the invention.
Figure 20A:
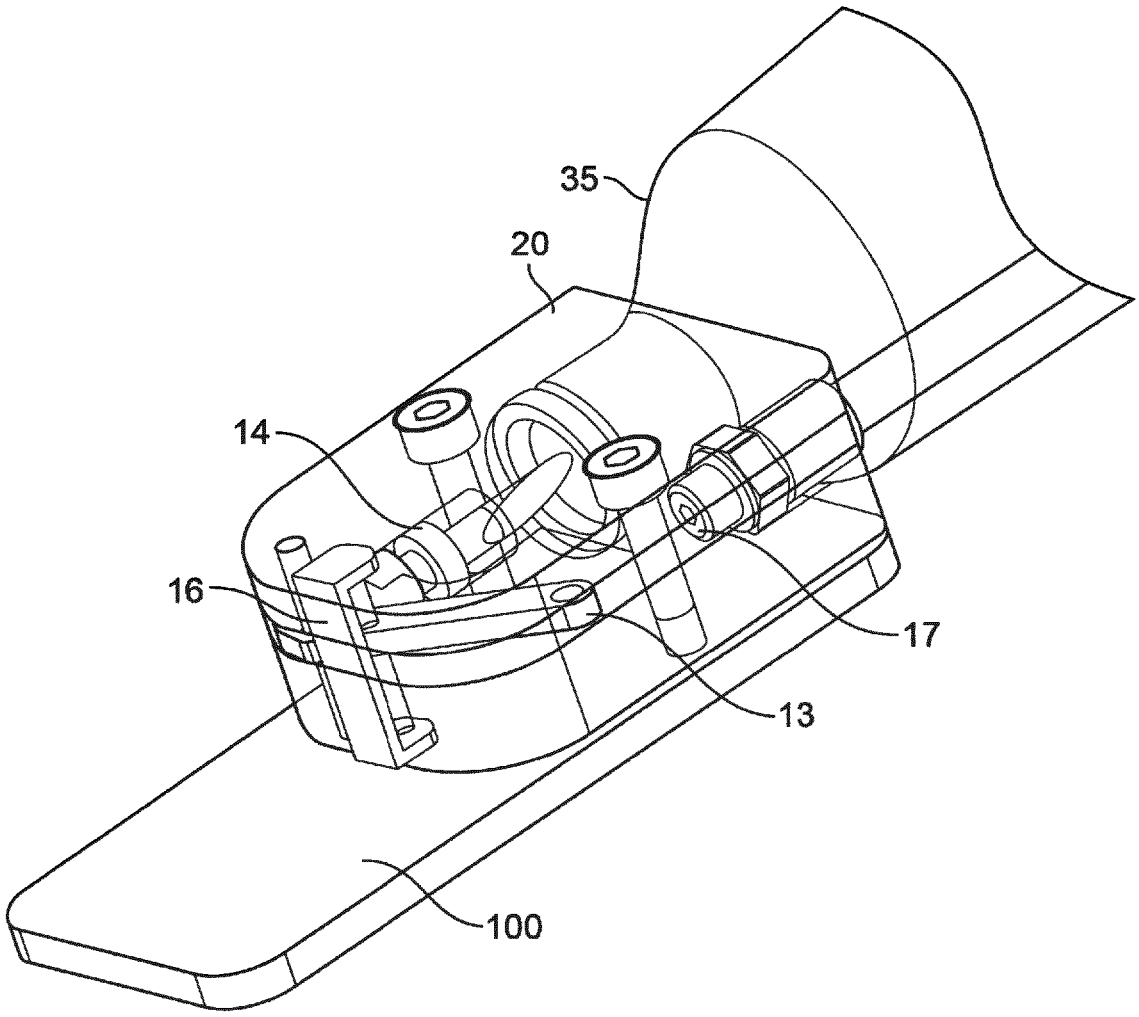
FIG. 20A shows a partial enlarged view of FIG. 20.

FIGS. 20 and 20A show an alternative arrangement of an inflation system. In this arrangement the inflation system 31 includes a compressed gas cylinder 5 and an activation mechanism 7, similar to the known arrangement. When activated, compressed gas from the cylinder 5 passes into a tube 35 from where it is passed to the bladder 9 in order to inflate the bladder 9. The inflation system can be activated manually by pulling on the lever 13, which moves spring-loaded piercer 14 to pierce a membrane of the gas cylinder 35 to release the gas.

An indicator clip 16 provides a visual indication of whether the inflation system 31 has been used. A connector 17 for a further tube for transfer is optionally provided.

Figure 2:
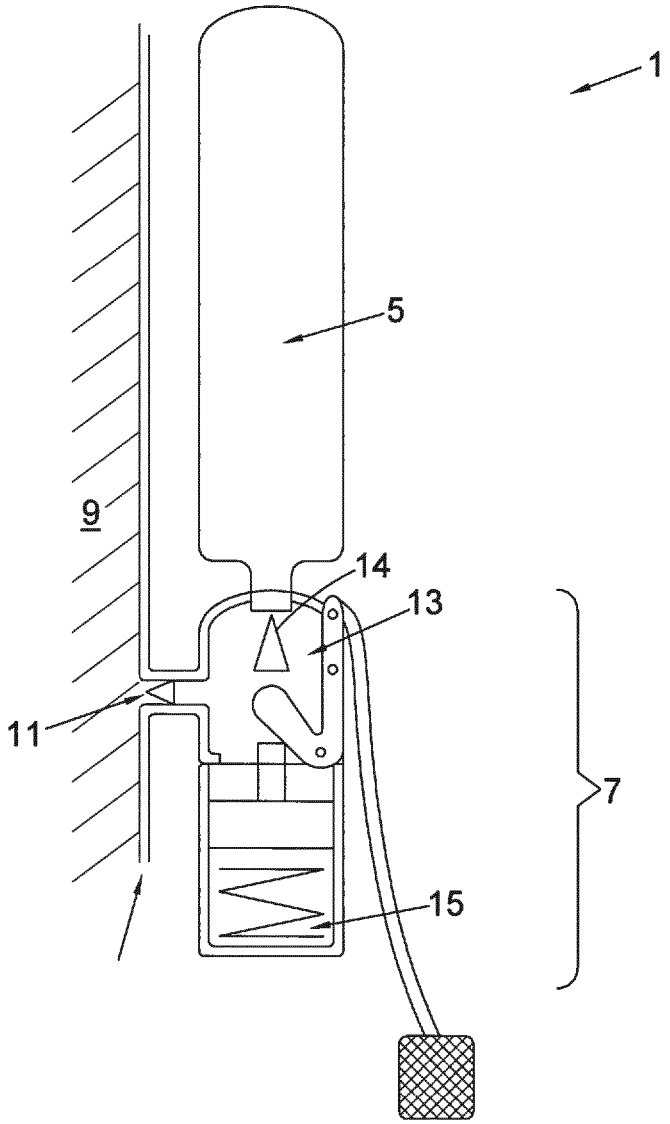
Fig. 2 Prior art
FIG. 2 shows a partial cross-sectional view of the inflator and bladder of the lifejacket of FIGS. 1A and 1B.
Figure 21:
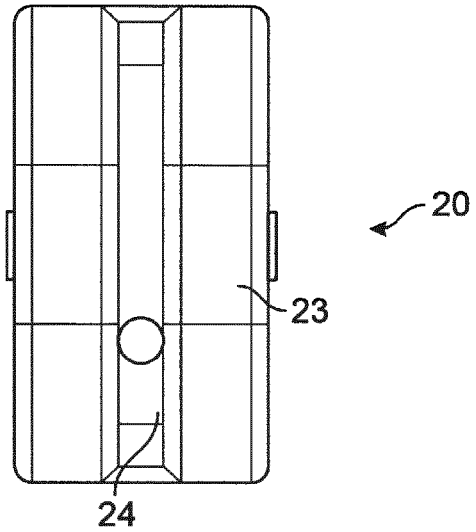
FIG. 21 shoes a bottom view of the housing of the inflation system according of FIG. 20.
Figure 21A:
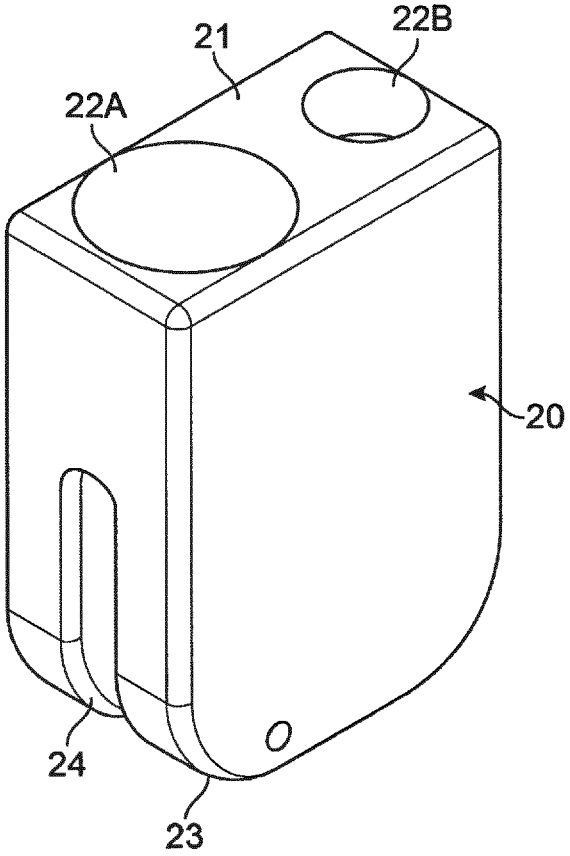
FIG. 21A shoes a perspective view of the housing of the inflation system according of FIG. 20.

The activation mechanism 7 is provided in a housing 20, shown in more detail in FIGS. 21A to 2. The housing 20 has a top surface 21 with a first opening 22A to receive the gas cylinder 5 and a second opening 22B to receive the tube 35. The bottom surface 23 has a recess 24 formed therein that extends into at least one sidewall. The recess accommodates the moveable lever 13. A rear surface of the housing 20 may be fixed to a mounting plate 100.

Figure 22:
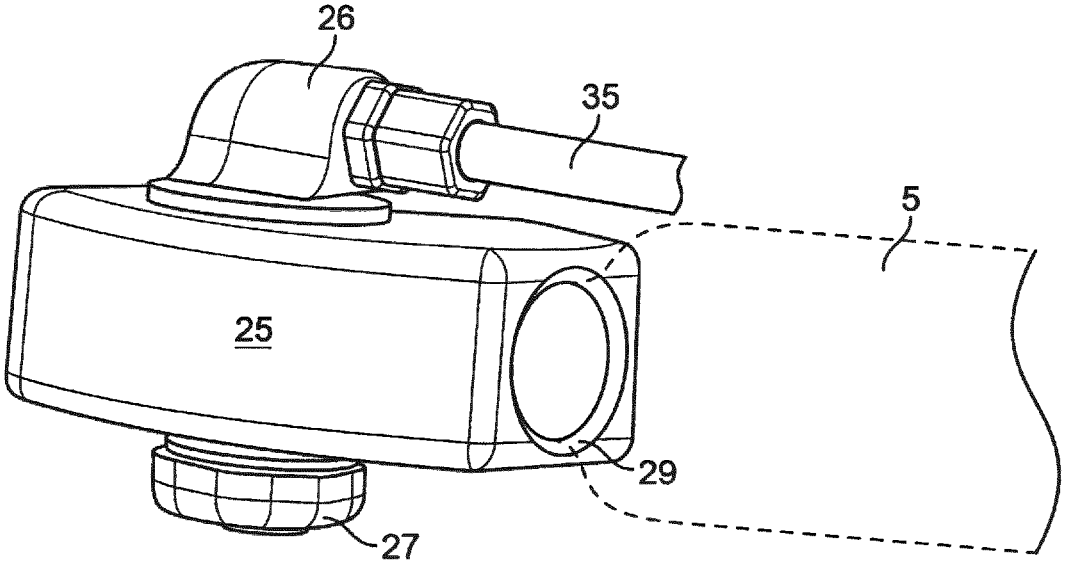
FIG. 22 shows a perspective view of a another modified inflation system according to a first embodiment of the invention.
Figure 23A:
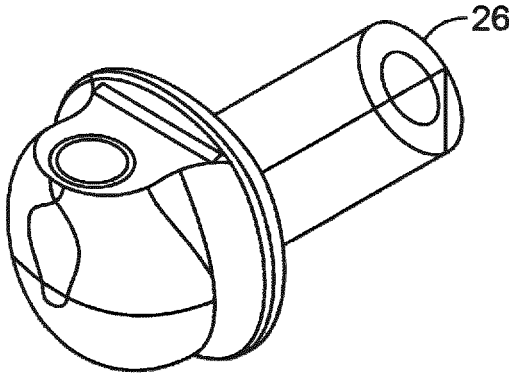
FIG. 23A shoes a perspective view of the adaptor of the inflation system according of FIG. 22.
Figure 23B:
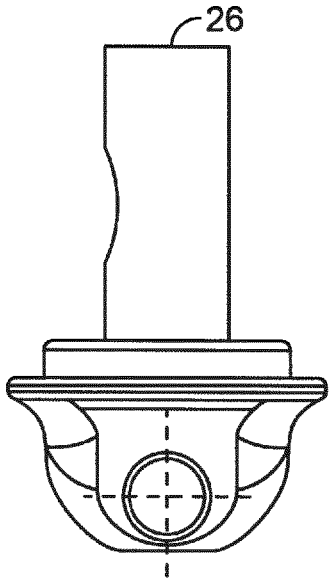
FIG. 23B shows a top view of the adaptor of the inflation system according of FIG. 22.
Figure 23C:
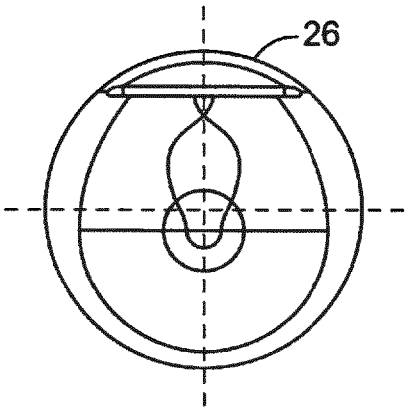
FIG. 23C shows a front view of the adaptor of the inflation system according of FIG. 22.
Figure 23D:
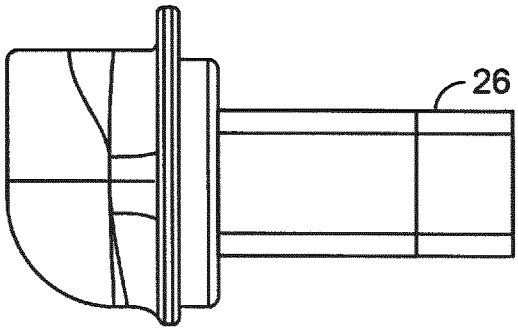
FIG. 23D shoes a side view of the adaptor of the inflation system according of FIG. 22.
Figure 24A:
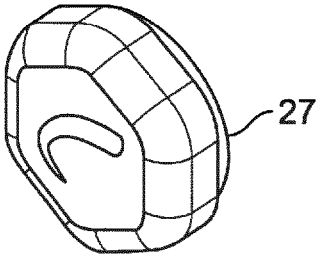
FIG. 24A shoes a perspective view of the cap nut of the inflation system according of FIG. 22.
Figure 24B:
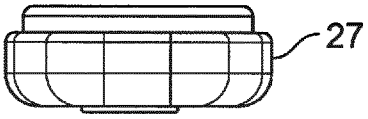
FIG. 24B shows a top view of the cap nut of the inflation system according of FIG. 22.
Figure 24C:
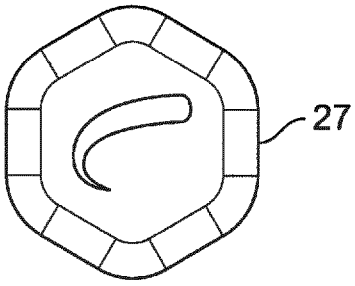
FIG. 24C shows a front view of the cap nut of the inflation system according of FIG. 22.
Figure 24D:
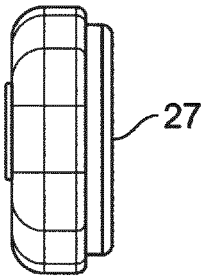
FIG. 24D shoes a side view of the cap nut of the inflation system according of FIG. 22.

FIG. 22 shows an adaptor housing 25 so that a COTS (commercial off the shelf) inflation mechanism (manual or automatic/water-activated) can be adapted using this adaptor housing 25 so that the gas flow is directed from the gas cylinder 5 into the flexible tube 35 (rather than conventionally going through a "D Post" into a bladder). FIGS. 23A-D show in more detail the adaptor 26 and FIGS. 24A-D show shows in more detail the cap nut 27. The outlet 28 of the adaptor 26 is connected to the tube 35 receives gas from the gas cylinder 35 via the adapter housing inlet 29.

Figure 25:
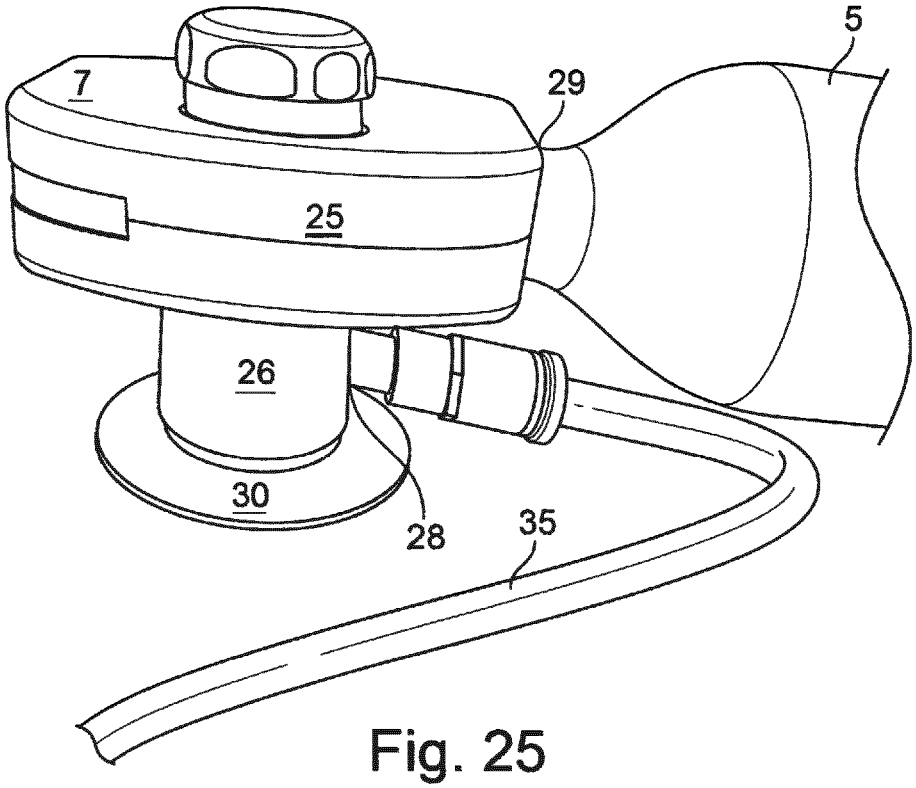
FIG. 25 shows a perspective view of a another modified inflation system according to a first embodiment of the invention.
Figure 26A:
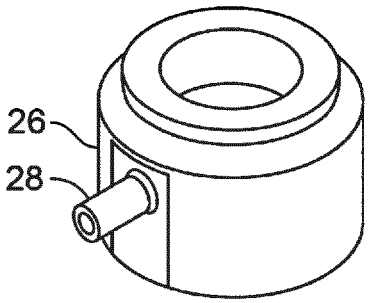
FIG. 26A shoes a perspective view of the adaptor of the inflation system according of FIG. 25.
Figure 26B:
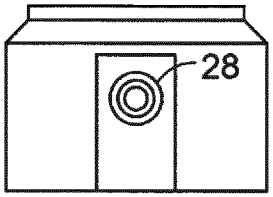
FIG. 26B shows a side view of the adaptor of the inflation system according of FIG. 25.
Figure 26C:
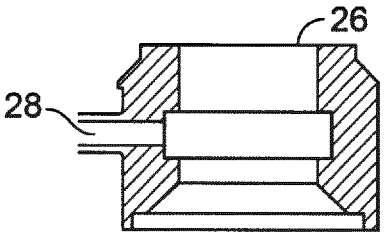
FIG. 26C shows a cross-sectional view of the adaptor of the inflation system according of FIG. 25.
Figure 27A:
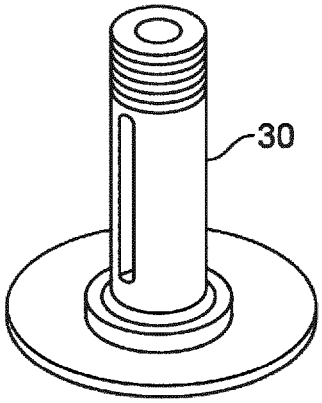
FIG. 27A shoes a perspective view of the D-post of the inflation system according of FIG. 25.
Figure 27B:
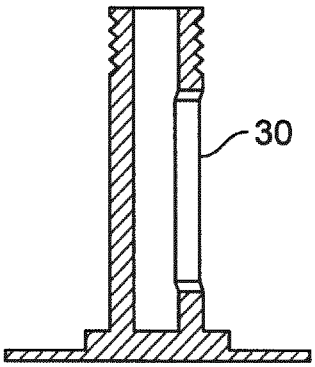
FIG. 27B shows a side view of the D-post of the inflation system according of FIG. 25.
Figure 27C:
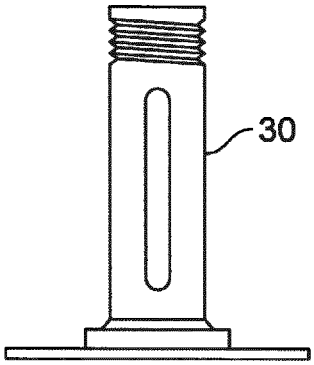
FIG. 27C shows a cross-sectional view of the D-post of the inflation system according of FIG. 25.
Figure 28:
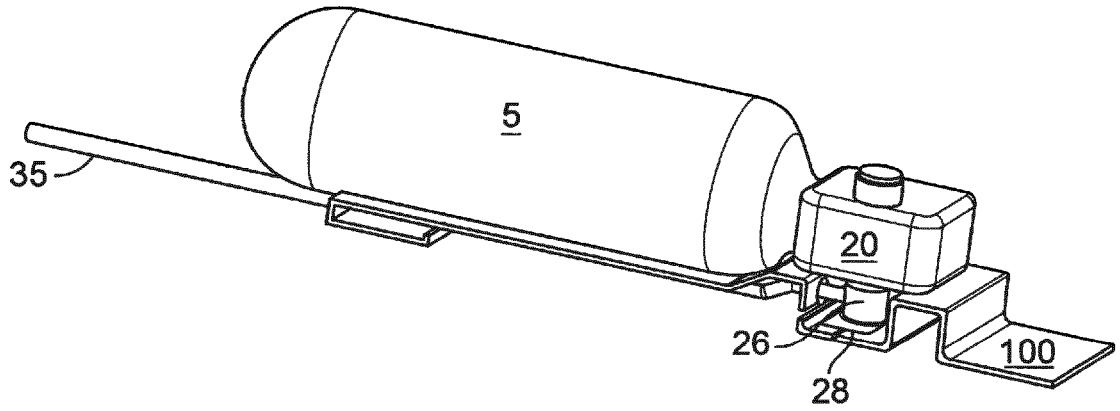
FIG. 28 shoes a perspective view of the inflation system of the inflation system according of FIG. 25 on a mounting plate.

FIG. 25 shows an alternative adaptor housing 25 so that a COTS (commercial off the shelf) inflation mechanism (manual or automatic/water-activated) can be adapted using this adaptor housing 25 so that the gas flow is directed from the gas cylinder 5 into the flexible tube 35. FIGS. 26A-C show in more detail the "banjo" adaptor 26 and FIGS. 27A-C show shows in more detail a D-post 30. The outlet 28 of the adaptor 26 is connected to the tube 35 receives gas from the gas cylinder 5 via the adapter housing inlet 29 and the D-post 30 that passes though the "banjo" adaptor 26 and into the adaptor housing 25. As shown in FIG. 28 rear surface of the housing 20 may be fixed to a mounting plate 100. The mounting plate 100 may include a recess 102 for accommodating the D-post 30 and the "banjo" adaptor 26, which recess also includes an opening through which the tube 35 passes.

Figure 29:
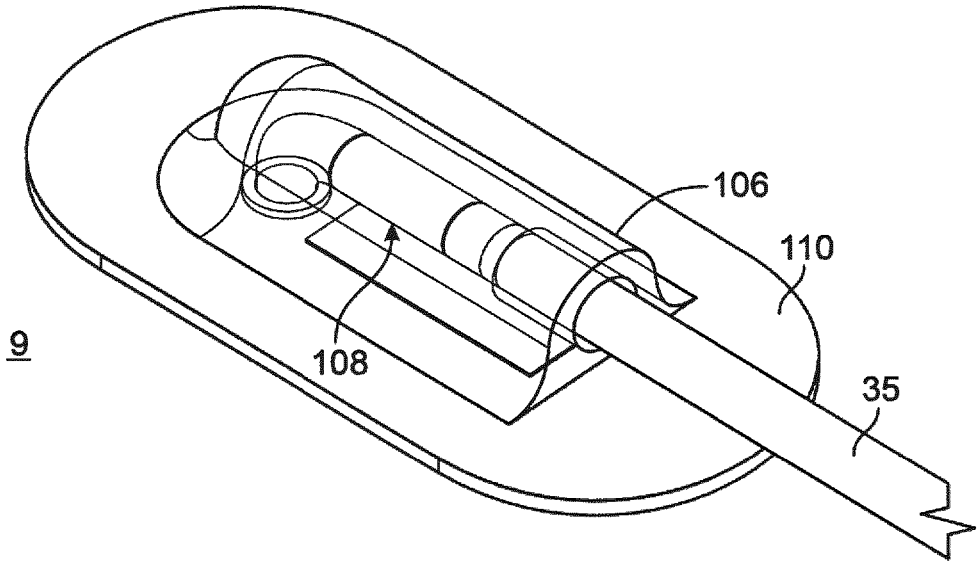
FIG. 29 shows an inlet port that fits onto a bladder.

FIG. 29 shows an inlet port 106 that fits onto the bladder 9 and to which the gas hose 35 is fitted. There is a small one-way check valve 108 fitted inside the flange 110 (to prevent back flow out of the bladder 9 if the tube 35 becomes detached or is punctured). The flange 110 may be coupled to the surface of the bladder 9 so as to provide a fluid tight connection between the tube 35 and the bladder 9.

This first embodiment may use the inflation system of the third embodiment, and may additionally or alternatively house the inflation system in sealable chamber as described in relation to the third embodiment.

Second Embodiment

Figures 4, 5A, 5B:
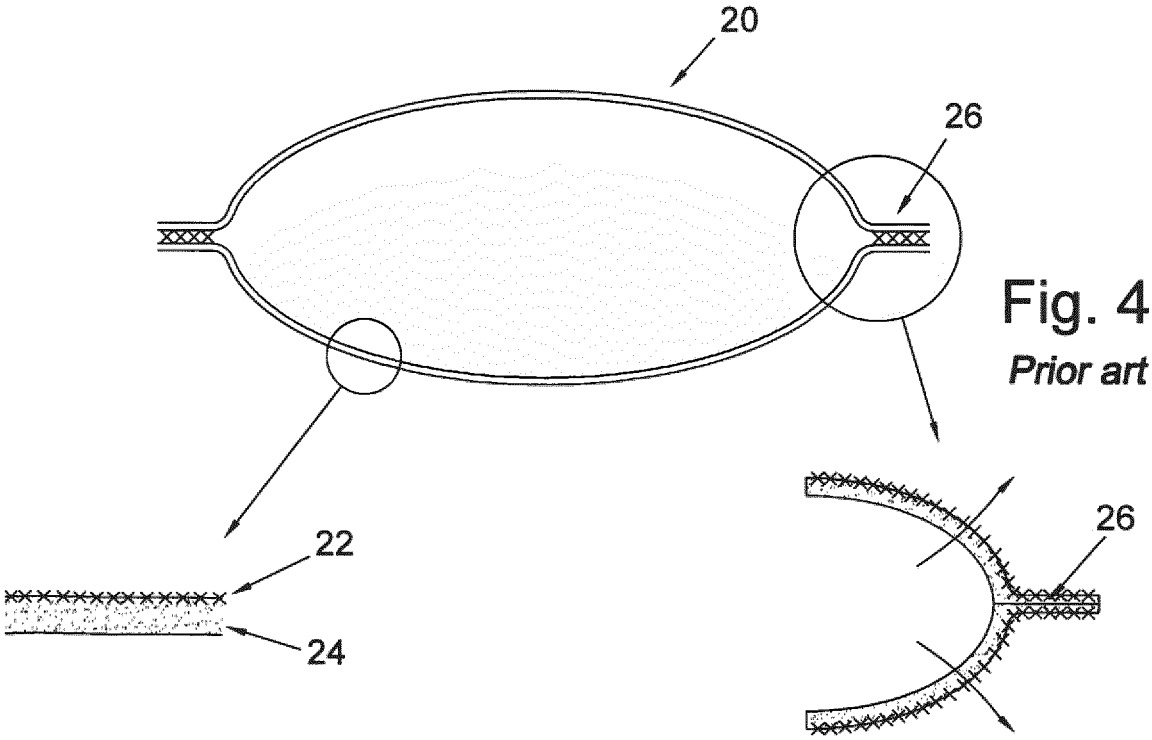
Fig. 4 Prior art
Fig. 5A Prior art
Fig. 5B Prior art
FIG. 4 shows a cross-sectional view taken of the inflatable chamber of the known lifejacket.
FIG. 5A shows a close up detailed view of the material forming the layer of the inflator chamber of FIG. 4.
FIG. 5B shows an enlarged detailed view of the inflated chamber at a seam region.

In this embodiment, instead of using a single layer of material that consists of a textile supporting sheet (for example nylon or polyester) coated or laminated on the inside with a sheet of flexible air impermeable polymer such as neoprene or polyurethane as described above with reference to FIGS. 4 and 5A-B, the two separate layers are provided (i.e. a textile outer layer and the separate inner polymer layer).

The use of two separate layers to make a bladder, results in a bladder construction that is lighter, more compact when packed and stronger.

As shown in FIGS. 10A-C, a textile outer layer 52 (for example nylon or polyester) may be formed of two sheets of material that are stitched together. An upper sheet of material 53A has an outer surface 57A and an inner surface 57B. The lower sheet of material 53B has an outer surface 58A and an inner surface 58B. The sheets 53A and 53B are connected at an edge region 59 of each of the sheets so that the distal inner surface of one of the sheets overlaps the distal outer surface of the other one of the sheets, the distal surfaces being stitched together, as indicated at 61. In the arrangement shown the distal inner surface 57B of the upper layer 57A is positioned to face the distal portion of the outer surface of the lower layer 53B, these layers being held in contact by the stitching 61.

The bladder 9 is formed by two sheets 54 or flexible air impermeable material. The two sheets are joined by a weld.

In this embodiment the outer textile 52 can be stitched (in sheer) around its edge and this creates a much stronger seam than the welding. The bladder 9 is made to be oversize or made from a polymer that can stretch and so the welded edge 56 never comes under tension, as shown in FIGS. 10A-C. Although the bladder 9 may be of generally the same shape as the outer textile 52, the bladder 9 may be of generally larger size. The bladder 9 may be made of a sufficiently large size so that, when inflated within the outer textile 52, the bladder 9 fills the internal volume of the outer textile 52 without any stretching of the bladder 9 occurring, and the tension is taken up by the outer textile 52. If the bladder 9 is made oversized, the bladder 9 may be made of an inextensible and/or inelastic material. It is advantageous for the tension to be taken up by the outer textile 52, as it is stronger than the bladder 9.

Preferably, the outer textile layer 52 is made from a lightweight "ripstop" material and is coated with a lubricant such as silicone. This produces an extremely strong material with high tear strength, and also, because the surface has a very low surface friction, the inner polymer layer will slide easily over it which results in a very compact lifejacket.

Ripstop fabrics are woven fabrics, e.g. made of nylon, using a special reinforcing technique that makes them resistant to tearing and ripping. During weaving, relatively thick reinforcement threads are interwoven at regular intervals in a crosshatch pattern. The intervals are typically 5 to 8 mm. Thin and lightweight ripstop fabrics have a 3-dimensional structure due to the thicker threads being interwoven in thinner cloth.

Third Embodiment

The third embodiment relates to the use of a water protected inflator.

Figure 11:
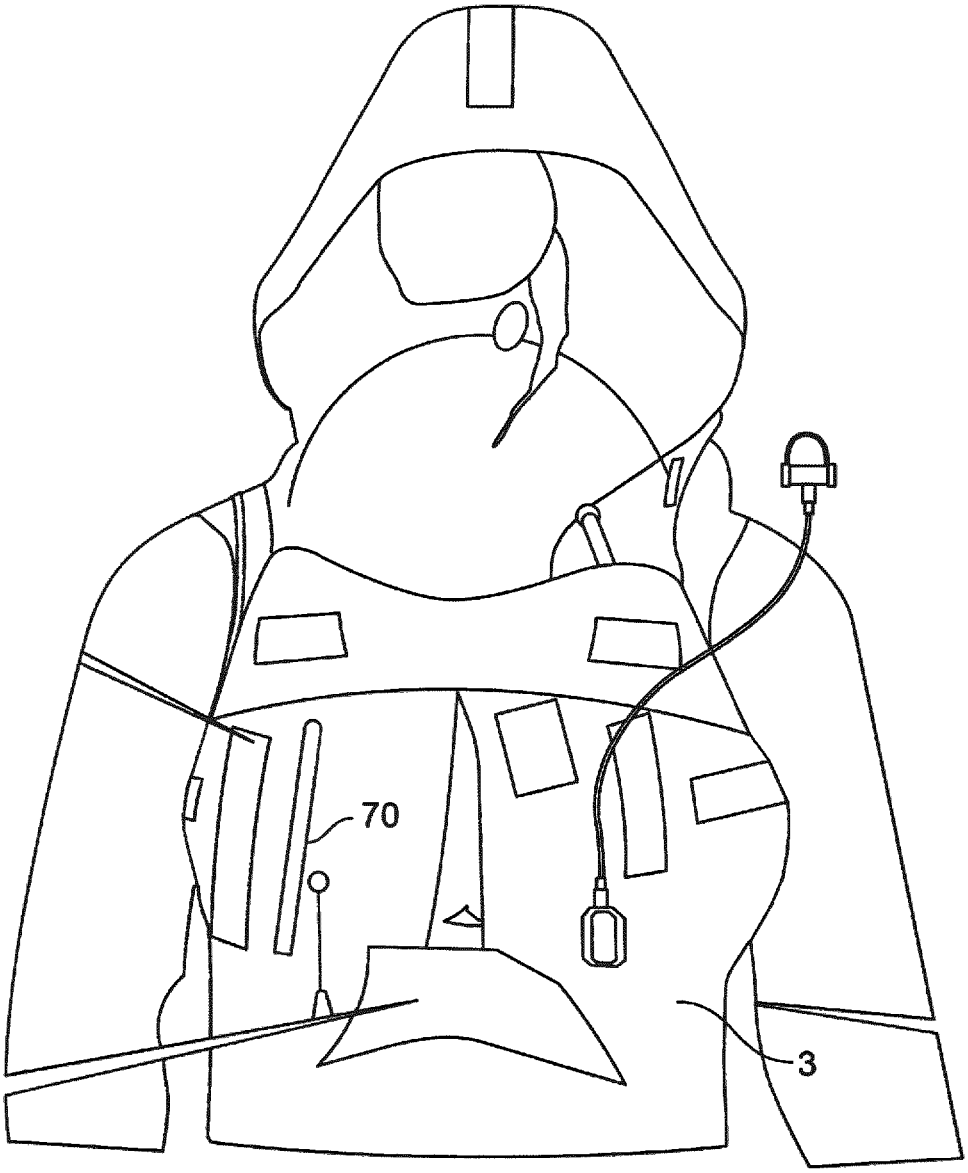
FIG. 11 shows a front elevational view of a lifejacket having a selectively sealable chamber for housing an inflator in accordance with a third embodiment of the invention.
Figure 12:
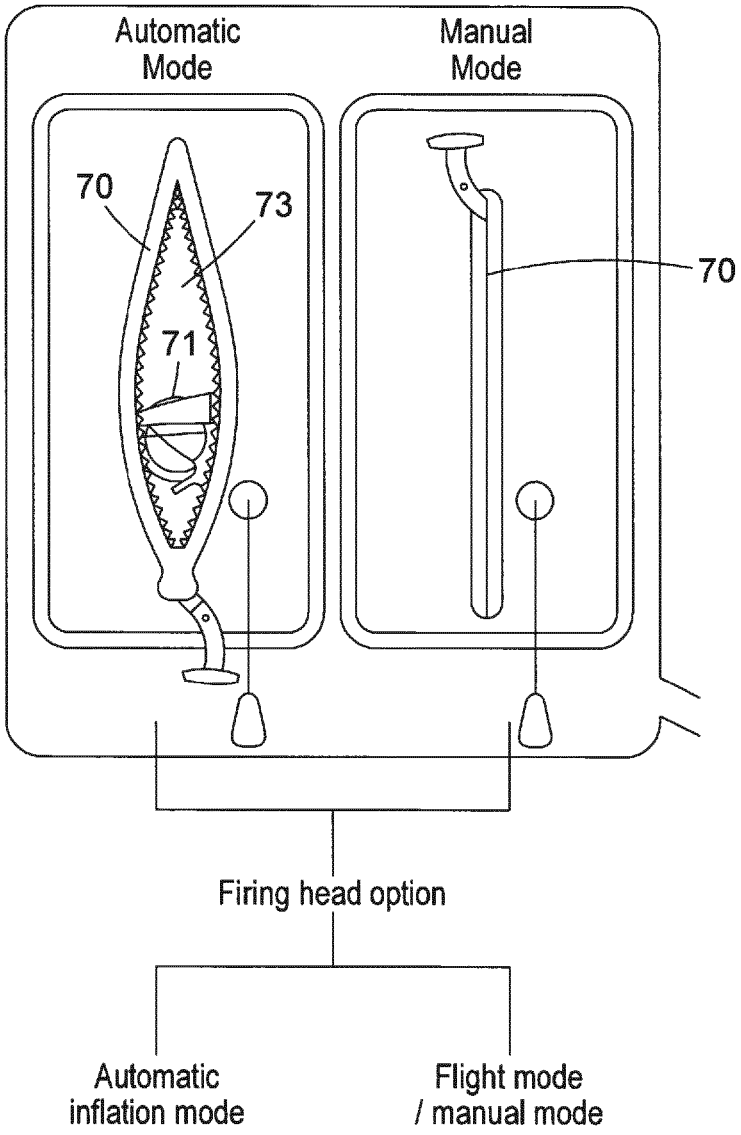
FIG. 12 shows a zipper of the selectively sealable chamber in an open and closed position (automatic mode and manual mode)

FIG. 11 shows an example lifejacket 3 according to a third embodiment of the invention. The lifejacket 3 includes an inflator that is contains in a selectively sealable chamber 73 formed in the lifejacket 3, the chamber being selectively sealable by operation of a zipper 70. The operation of the zipper is shown in FIG. 12. When the zipper 70 is open the inflator 71 is exposed, and so if the lifejacket 3 is immersed in water the automatic inflator 71 will be triggered. In contrast, when the zipper 70 is closed, the inflator 71 is not exposed and is sealed within a fluid-tight chamber 73 in the lifejacket 3. When the zipper 70 is closed, the inflator 71 is not exposed to the environment outside the chamber, and so if the lifejacket 3 is immersed in water, the inflator will not automatically trigger. Thus, the lifejacket has an "automatic" inflation mode and a "manual" inflation mode.

The chamber 73 may be attached to the bladder 9 and surrounds the gas cylinder 5, the release mechanism 75 and the piercing spike 14. The chamber 73 may be completely or partially formed integrally with the bladder 9 that provides buoyancy to the lifejacket 3. The chamber 73 may be completely or partially formed from the same material as the bladder 9 that provides buoyancy to the lifejacket 3.

Figure 13A:
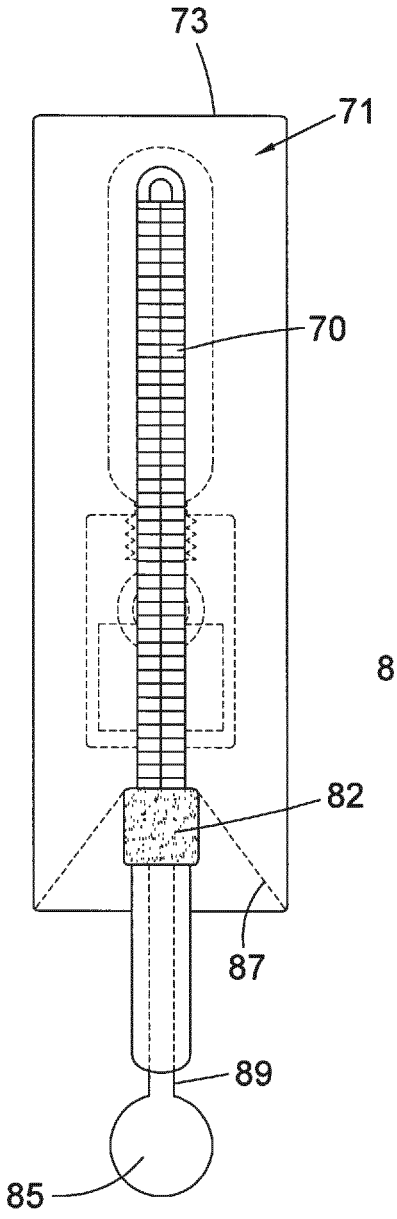
FIG. 13A shows a front elevational detailed view of the zipper and chamber of the third embodiment with the zipper of the selectively sealable chamber closed.
Figure 13B:
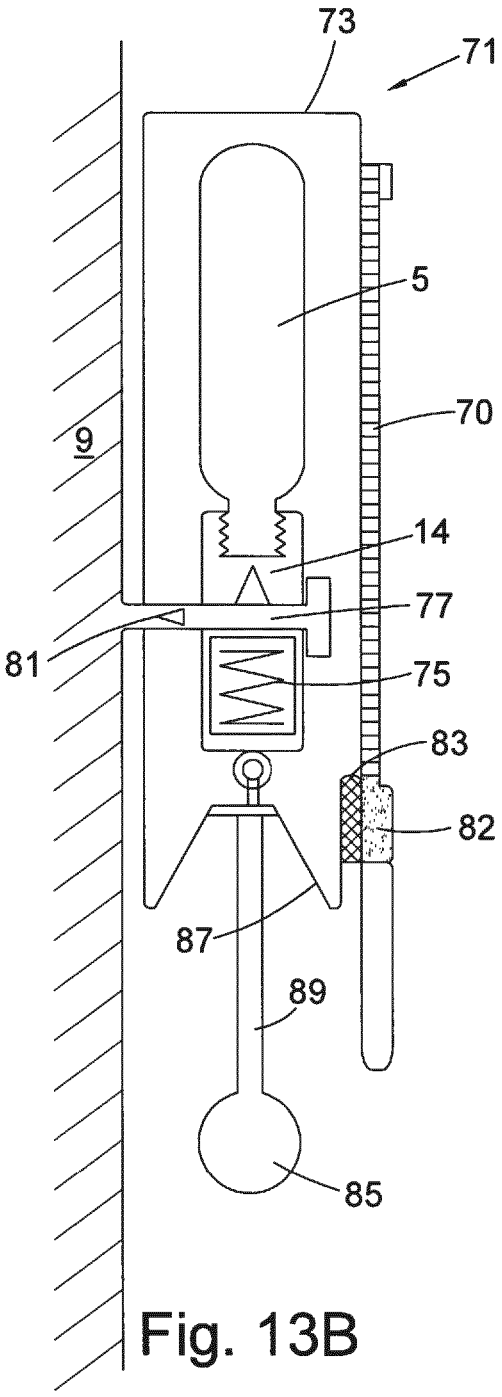
FIG. 13B shows a partial cross-sectional side elevational view of the third embodiment with the zipper of the selectively sealable chamber closed.
Figure 14A:
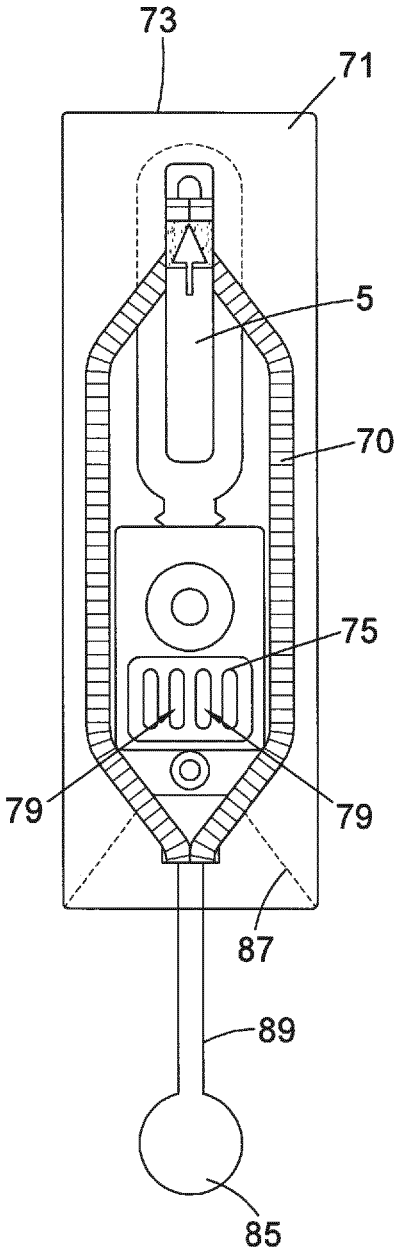
FIGS. 14A and 14B show views corresponding to FIGS. 13A and 13B, but with the zipper open.
Figure 14B:
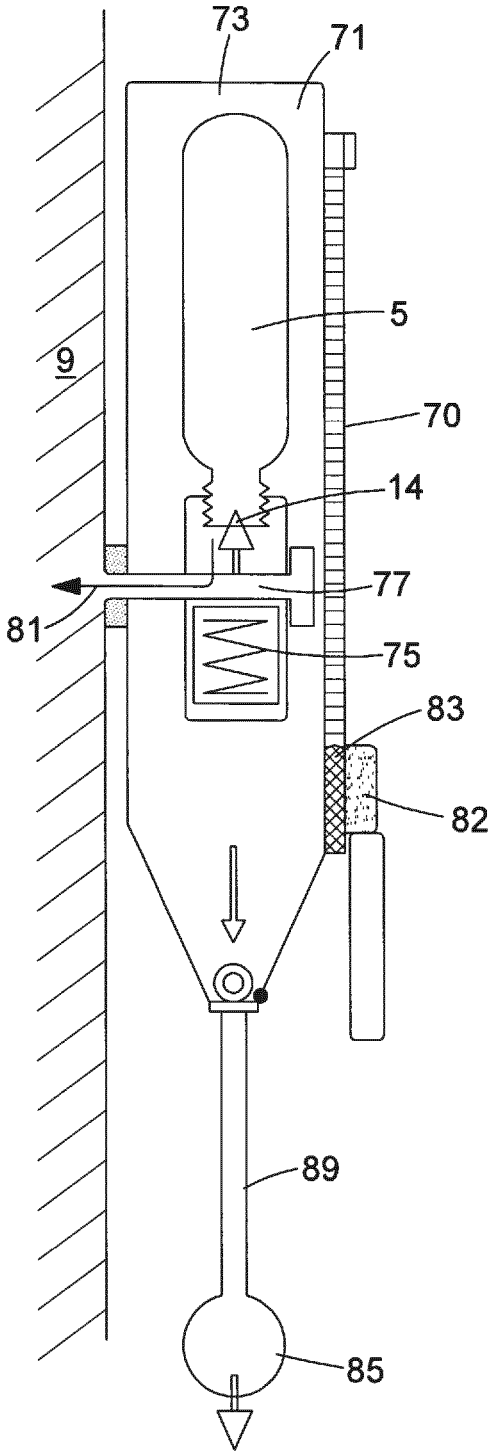

The configuration and operation of the third embodiment will be described in more detail with reference to FIGS. 13 and 14. FIG. 13 shows the zipper 70 in a closed state, and FIG. 14 shows the zipper 70 in an open state.

The inflator 71 comprises a compressed gas container 5. Compressed gas is released from the container 5 by movement of the spring loaded piercing spike 14. The spring loaded piercing spike 14 is held apart from the container 5, against the action of the spring by an automatic release 75, that on significant contact with water, releases the spring loaded piercing spike 74 to pierce the seal of the container 5 to release the compressed gas.

The automatic release may comprise a compressed salt pellet (such as one available from Halkey Roberts), a paper cartridge (such as one available from United Moulders) or a paper element protected by a hydrostatic valve (such as available from Hammar).

When the seal of the container 5 is pierced by the piercing spike 14, the gas from the container 5 flows along conduit 77 via an inlet valve 81 into the bladder 9 of the lifejacket 3 in order to inflate the lifejacket.

In FIG. 13 the zipper 70 is closed, and so water cannot reach the automatic actuator 75, and so inflation of the bladder 9 will not be automatically activated even if the lifejacket 3 is immersed in water.

FIG. 14 shows the zipper 70 in an open state. In this state water will flow into the chamber 71 and will reach the automatic actuator 75, as indicated by arrow 79, and will cause release of the spring-loaded piercing pin 14 to puncture the seal of the container 5 in order to release the compressed gas, as indicated by the arrow 81.

The zipper 70 slider may be fitted with a device 83 to ensure that it is fully closed. Such a device 83 may be an indicator attached to a press stud or an electronic "tag" that gives a signal when closed. The zipper slider is designated 82 in the drawings.

There may be an indicator, similar to 83, at the upper (opened) end of the zipper 70.

Manual inflation of the bladder 9 may be required when the zipper is closed (and automatic operation is deactivated) or at any time when a wearer wishes to pre-inflate the bladder, such as when the wearer knows that they are about to enter water. A pull knob 85 provided for this purpose for operation by the wearer (or other personal). A reverse fold 87 may be formed in the chamber 73 whereby the pull knob 85 chord 89 is sealed onto the chamber 73. Other ways of releasing the manual pull knob 85 may be used, such as by tearing a seal or pulling out a plug.

Figure 15A:
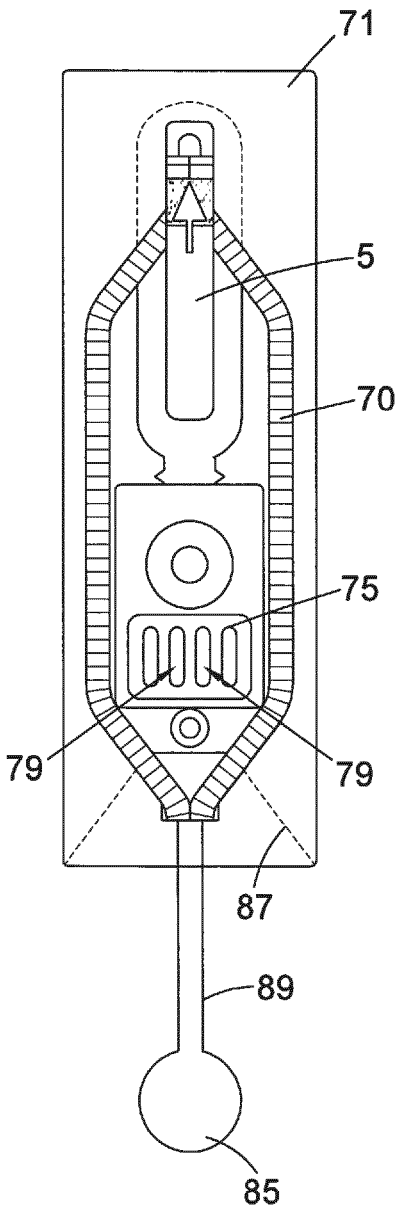
FIGS. 15A and 15B correspond to FIGS. 14A and 14B, but with the inflator mounted remotely from the bladder, in accordance with the first embodiment.
Figure 15B:
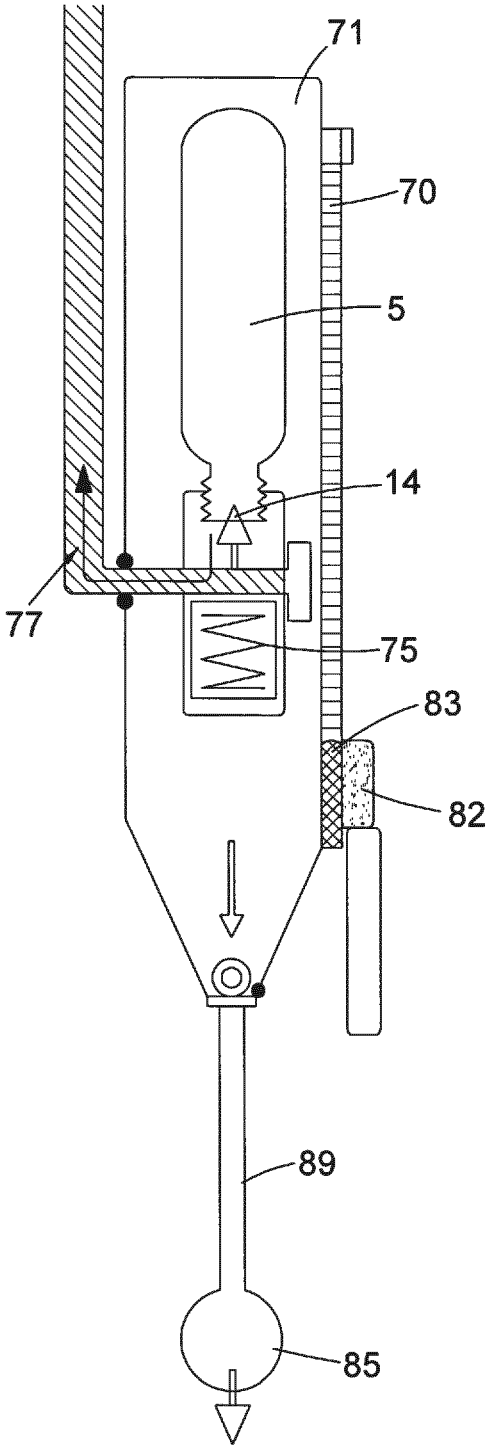
Figure 16A:
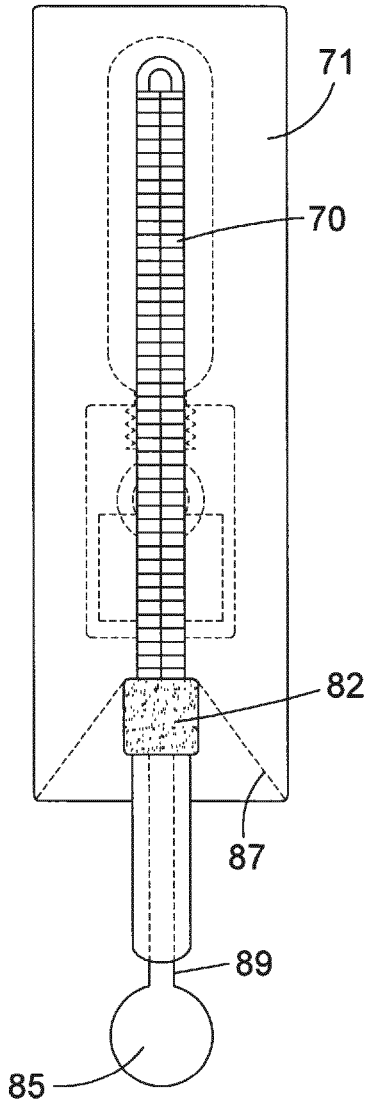
FIGS. 16A and 16B correspond to FIGS. 13A and 13B but with the inflator remote from the bladder in accordance with the first embodiment.
Figure 16B:
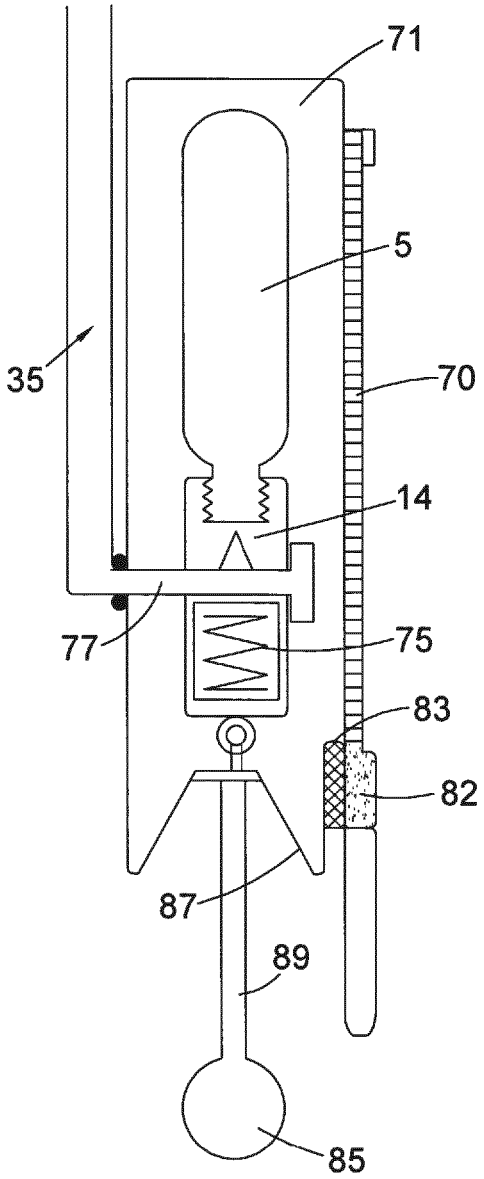

FIGS. 15 and 16 correspond generally to FIGS. 13 and 14, but show the water protected inflator embodiment used in combination with the remote inflation system of the first embodiment. When the piercing spike 14 pierces the seal of the compressed gas container 5, the gas flows along the conduit 77 and then along the tube 35 to the bladder 9, as described in relation to the first embodiment.

The first embodiment of the remote inflation system lends itself to this waterproof pouch concept. FIGS. 15 and 16 show how the waterproof pocket can be used with the water protected inflator concept. The ability of the inflation system to be converted from manual to automatic (water activated) has already been described, but the benefit with the remote inflation system is enhanced.

Fourth Embodiment

The fourth embodiment relates to the construction of the outer cover.

Figure 3A:
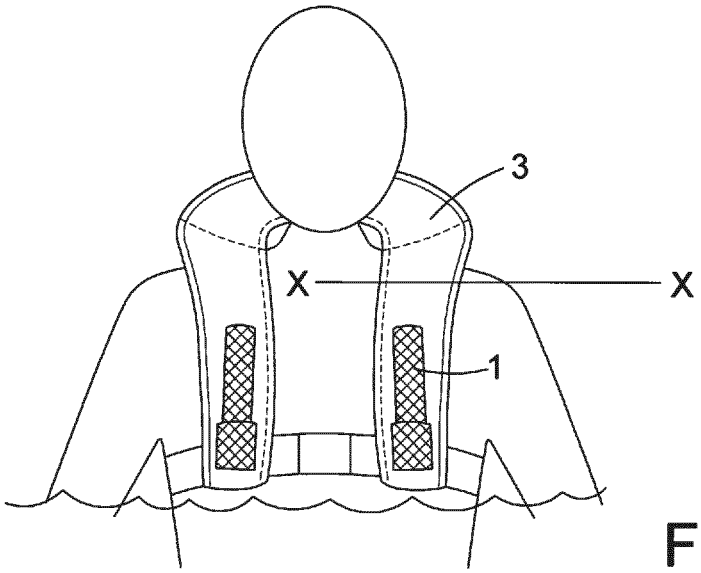
Fig. 3A Prior art
FIG. 3A shows a front elevational view of the known lifejacket when the wearer is partially immersed in water.
Figure 3B:
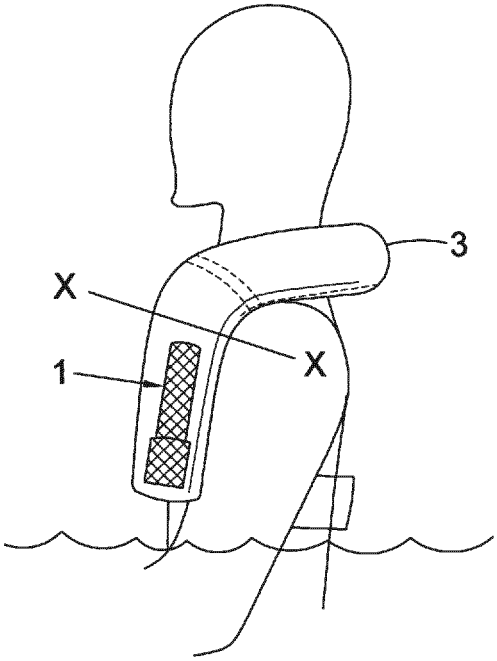
Fig. 3B Prior art
FIG. 3B shows a side elevation of the partially immersed wearer corresponding to FIG. 3A.
Figure 18:
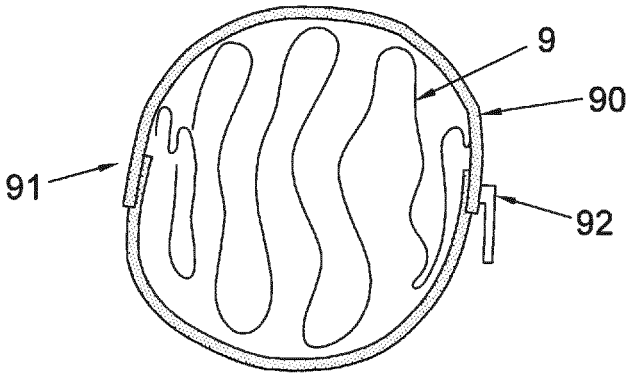
FIG. 18 shows a cross-section X-X of the conventional cover illustrated in FIGS. 3A and 3B.

As mentioned above, typically covers for inflatable lifejackets are designed by making an outer cover from stitched or welded panels of a textile that are shaped to conform to the overall shape of the bladder when it is deflated FIGS. 3A and 3B. FIG. 18 shows the construction of such a cover in more detail.

The cover 90 is made from a fabric or a plastic reinforced with a textile and is made to be a shape to conform to the wearers neck and torso. It is usually made by seaming together cut panels of the cover material. 91 is a typical seam. The cover is closed by a zipper 92, or by Velcro or press studs or a combination. If a zipper is used it is usual to incorporate a short lengthy of the zipper without the "teeth" such that when the bladder is inflated a section of the bladder will begin to open out and then the zipper "peels open" this is known as a "burst" zipper. FIGS. 8A and 8B show how the cover opens to allow the bladder to become fully inflated. The cover is closed over the bladder by a zipper or Velcro® or press studs etc. built into the cover such that when the bladder is filled with gas from the inflation system the pressure of the gas inside the cover will open the zipper or Velcro or press studs and allow the bladder to expand outwards.

Figure 19:
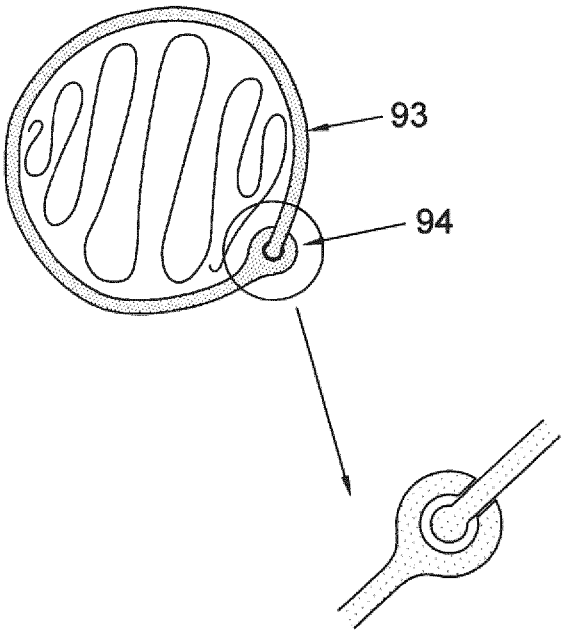
FIG. 19 shows an example moulded seamless cover.

In contrast, according to this embodiment, a moulded cover constructed from a flexible polymer is used as an alternative to the known panels of material joined together. The cover is seamless and has a number of benefits. The smooth moulded outer cover is less liable to damage and wear and is cheaper to manufacture. The closure of the moulded cover can be by use of a "tongue and groove seam" like a "ziplock bag". FIG. 19 shows the cross section through the packed lifejacket. The moulded "seamless cover 93 is closed by a "tongue and groove" or "ziplock" type seal. This closure is designed to be strong enough not to open in use and rough handling etc. but will still open when the bladder begins to inflate.

The invention claimed is:

1. A personal survival system for use in water including:
- an inflatable chamber;
- an inflation system operable to inflate the inflatable chamber;
- a tube providing a fluid connection between the inflation system and the inflatable chamber; and
- a mounting system configured to locate the inflation system separately from and remotely from the inflatable chamber so that they are spaced apart on a wearer's body at substantially the same positions prior to and after inflation of the inflatable chamber;
- the inflation system comprising:
  - a mounting plate;
  - a housing that is coupled to the tube, the housing being fixed to the mounting plate; and
  - a manually operated activation mechanism, the activation mechanism being provided in the housing.

2. The personal survival system of claim 1, wherein the inflation system and the inflatable chamber are mountable on a wearer's body.

3. The personal survival system of claim 2, wherein the inflation system is mountable on the wearer's body at a position that is more likely to be fully immersed in water in an emergency than the inflatable chamber.

4. The personal survival system of claim 1, wherein the inflation system comprises a compressed gas container.

* * * * *